United States Patent [19]

Hughes

[11] 4,059,059

[45] Nov. 22, 1977

[54] PROTECTIVE SYSTEM

[76] Inventor: Bernard J. Hughes, 6 E. 37th St., New York, N.Y. 10016

[21] Appl. No.: 616,956

[22] Filed: Sept. 26, 1975

[51] Int. Cl.[2] ..... E05G 1/00

[52] U.S. Cl. ..... 109/1 R; 109/47; 160/1

[58] Field of Search ..... 109/1 R, 2, 3, 10–18, 109/45, 46, 47; 49/1, 5; 160/1–9

[56] References Cited

U.S. PATENT DOCUMENTS

| | | | |
|---|---|---|---|
| 9,455 | 3/1836 | Harrington | 109/47 |
| 142,174 | 8/1873 | Parke | 109/45 |
| 1,226,077 | 5/1917 | Jope | 160/7 |
| 1,752,578 | 4/1930 | Schneyer et al. | 109/12 |

FOREIGN PATENT DOCUMENTS

| | | | |
|---|---|---|---|
| 1,282,837 | 12/1961 | France | 109/18 |
| 399,347 | 10/1933 | United Kingdom | 160/9 |

*Primary Examiner*—Paul R. Gilliam
*Assistant Examiner*—David H. Corbin
*Attorney, Agent, or Firm*—Paul J. Sutton

[57] ABSTRACT

This invention concerns itself with and discloses a system for protecting articles and works of value such as, without limitation, works of art. Upon the occurrence of predetermined and preselected conditions, such as the occurrence of a fire, this system will permit and causes a fireproof, flameproof, smokeproof and waterproof curtain to move and descend about the article to be protected. In addition, the article and the entire protective covering just described, in a preferred embodiment of this invention, is permitted and is caused to descend into a protective container until the emergency condition has passed, whereupon the entire structure may be mounted as it was originally.

1 Claim, 6 Drawing Figures

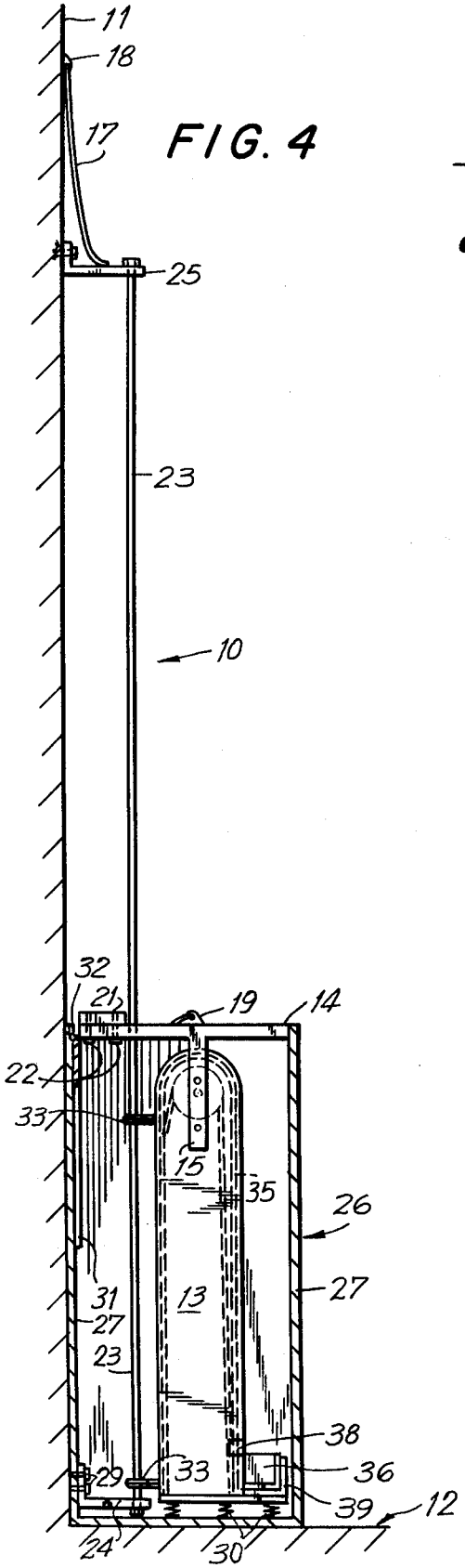
FIG. 4
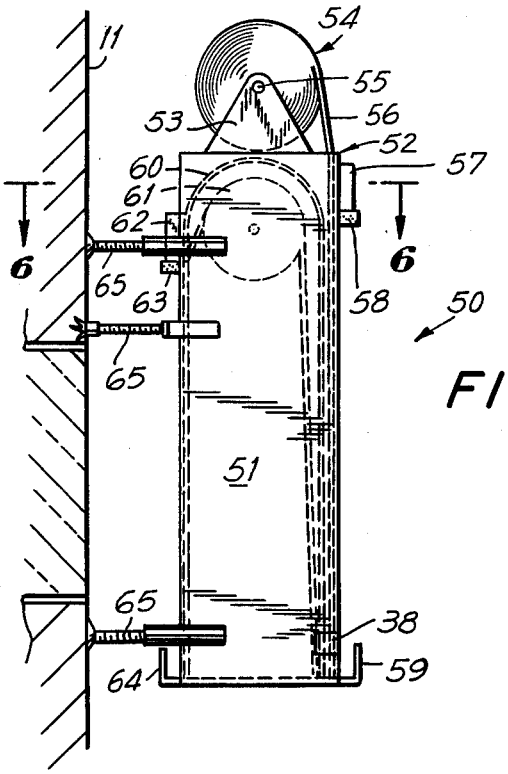
FIG. 5
FIG. 6
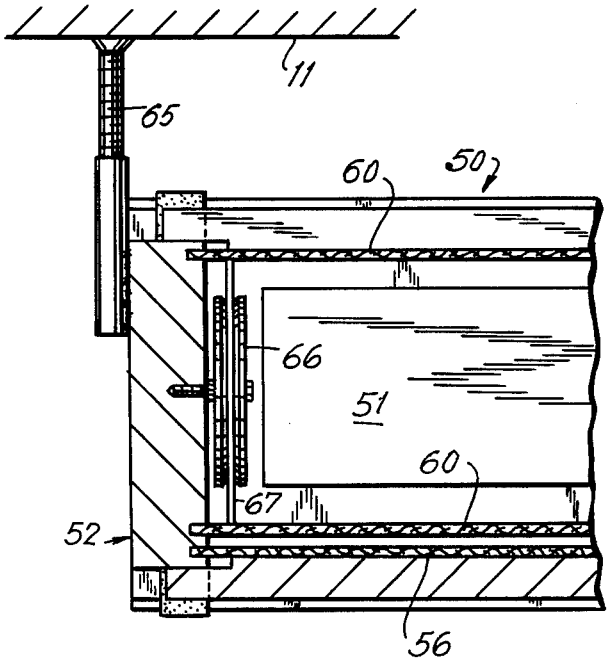

PROTECTIVE SYSTEM

This invention relates to protective devices and, more particularly, to a system for guarding and protecting works of art and of value.

Many millions of dollars worth of art and articles of value are destroyed every year by fire and water damage. In addition, countless numbers of valuable articles are stolen from establishments that are provided with guards and security systems. The losses to insurance companies are considerable and in many cases the loss of these articles cannot be measured in dollars and cents.

It is important here to emphasize the fact that conventional protective systems, even under optimum conditions, do not provide adequate protection for works and articles sought to be protected. How can one measure the value of original documents such as the Declaration of Independence or the Bill of Rights, just to mention a couple, which simply cannot be replaced if they are damaged. Of course, the problem resides in the desire to make these articles and works of value available for public viewing and inspection, while at the same time it is important that these articles be protected against fire or vandalism or theft.

Other environments in which protection should and must be afforded include libraries and computer rooms. Paper products, such as books, are highly susceptible to damage from heat or flames, while the advancement of the solid state art in the form of computerized technology has resulted in highly sophisticated computer equipment which is susceptible to undesirable levels of temperature. In many cases, computerized equipment is maintained in temperature-controlled environments where the characteristics of the solid state components will not be undesirably altered as a result of the higher levels of heat.

Conventional and prior efforts to protect the foregoing have resulted in a proliferation of security guards, fire alarms and sprinkler systems. Imagine the problem of providing a sprinkler system in a museum where the damage due to water may be as considerable as the damage resulting from exposure to fires and smoke. Certainly, a significant need exists for a protective system which is capable of use with any number of articles of value and works of art and which may be provided in all of the environments wherein such problems may arise. A need exists for a system which is not necessarily tied to a skilled labor force or any labor at all, for that matter, and which will operate automatically and efficiently under the preselected conditions for which it is designed.

It is an object of the present invention to provide a protective system which fulfills the aforementioned needs and which provides protective measures for guarding and protecting articles of value and works of art.

It is a further object of the present invention to provide a relatively inexpensive structure and system which will operate automatically and independently of personnel.

Another object of the present invention is to provide a plurality of embodiments of systems wherein protection is afforded to museums, libraries, computer rooms, etc. and wherein a foolproof and simple structural arrangement accomplishes these ends.

The present invention fulfills the aforementioned objects and overcomes the limitations and disadvantages of prior art efforts to solve these problems by providing, in one embodiment, a double-acting system for protecting works of art and articles of value. Very briefly, an arrangement is provided whereby a protective fireproof, flameproof, waterproof, smokeproof curtain is caused to descend by a weight ordinarily captively held by means of a fuse. The curtain drops to protect the work of art while, either simultaneously or about the same time, the entire work of art and this protective curtain is permitted and causes to descend into a protective container, as will be described in more detail below in connection with the next drawing.

My invention will be more clearly understood from the following description of specific embodiments of this invention, together with the accompanying drawings, wherein similar reference characters denote similar elements throughout the several views, and in which:

FIG. 4 is a sectional elevational view similar to FIG. 1, illustrating the operation of aspects of this embodiment of the invention;

FIG. 5 is a fragmentary sectional elevational view illustrating another preferred embodiment of my invention; and FIG. 6 is a fragmentary sectional plan view of a portion of the structure shown in FIG. 5 and further illustrating the invention.

Figure 1:
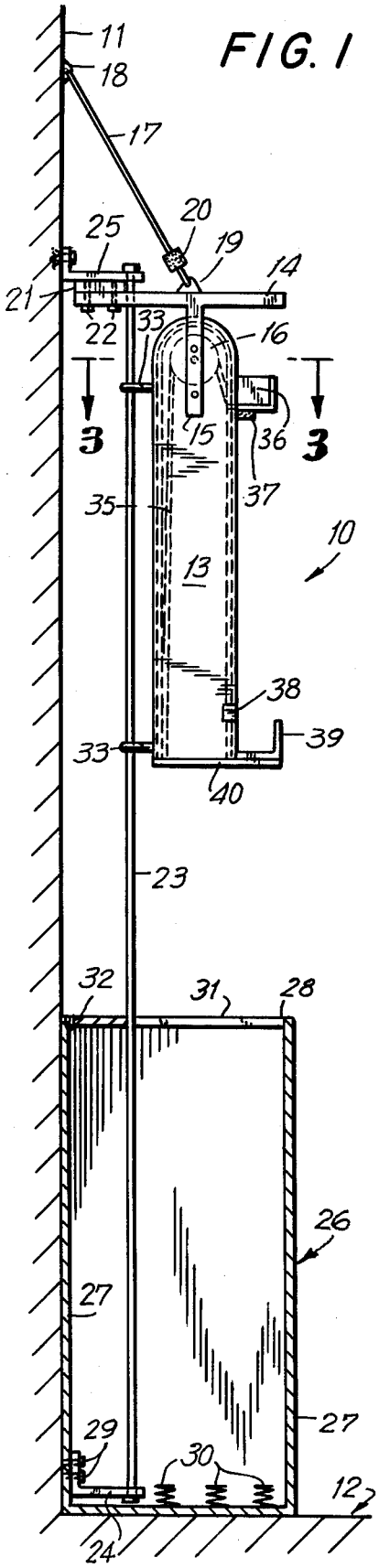
FIG. 1 is a fragmentary sectional elevational view of a preferred embodiment of my invention.

Referring now in more detail to the drawings and the several view depicting this invention therein, FIG. 1 illustrates in a fragmentary sectional elevational view one of the preferred embodiments of the protective system 10 forming part of my invention. A vertical wall 11 is shown fragmentarily as joining a floor 12. Wall 11 and floor 12 are merely shown to best describe one of the manners in which system 10 may be affixed to new or existing premises.

A painting 13 is shown in FIG. 1 suspended above fooor 12 and spaced from wall 11. It is very important here to advise the reader of this specification that the use of a painting 13 to describe my system should in no way limit the scope of this invention. My invention is capable of use with any article of value or any article which the user seeks to protect. Thus, other types of works of art, distinct from paintings, sculptures, photographs — just to name a few, may be protected from a variety of undesirable environments utilizing this invention.

A substantially horizontal plate 14 is disposed over the upper extremities of painting 13 and is integrally connected with downwardly extending struts 15. Struts 15 are preferably utilized as end members to which a wheel or pulley 16 is mounted. A plurality of wheels or pulleys 16 may be utilized, as will become more apparent from the description below. One or more cables 17 serve as means for supporting plate 14 in the position shown in FIG. 1 and interconnect wall 11 and plate 14 by means of bracket members 18 and 19. Cables 17 may alternatively comprise other forms of supporting members, such as the types of wire structures used in hangers. A fuse 20 is located along the length of cables 17 and is of a type which is sensitive to heat, for example.

This fuse 20 may interconnect segments of only one cable 17 or a plurality of segments of cables 17 such that another fuse is unnecessary with system 10. In this way, the user of system 10 need not rely upon the reliability of a plurality of fuses being activated simultaneously or at approximately the same time.

Fuse 20 forms a link in the supporting structure of plate 14, from which painting 13 is suspended by means of struts 15 and pulley wheels 16, as will become more apparent below. A counterweight 21 is secured by means of bolts 22 to the upper and inner surfaces of plate 14.

A plurality of vertically extending cables 23, preferably two, extend upwardly from an anchor bracket 24 adjacent floor 12, to a suspension bracket 25 disposed above plate 14. Brackets 24 and 25 are L-shaped with their vertical legs being secured to a vertical supporting surface, such as wall 11, while their horizontal legs provide the means for supporting the extremeties of cables 23.

A protective container 26 formed with upstanding walls 27 which define an opened top 28 is shown in FIG. 1 sitting upon floor 12 in the corner against wall 11. Anchor bracket 24 is shown secured by means of bolts 29 to the inner vertical surfaces of rear wall 27 of container 26. A plurality of shock absorbing, vertically extending helical springs 30 are located inside container 26 and are secured to the floor thereof. A hinged cover 31 normally closes open top 28, and is pivotally supported by means of a piano-type hinge 32.

Figure 3:
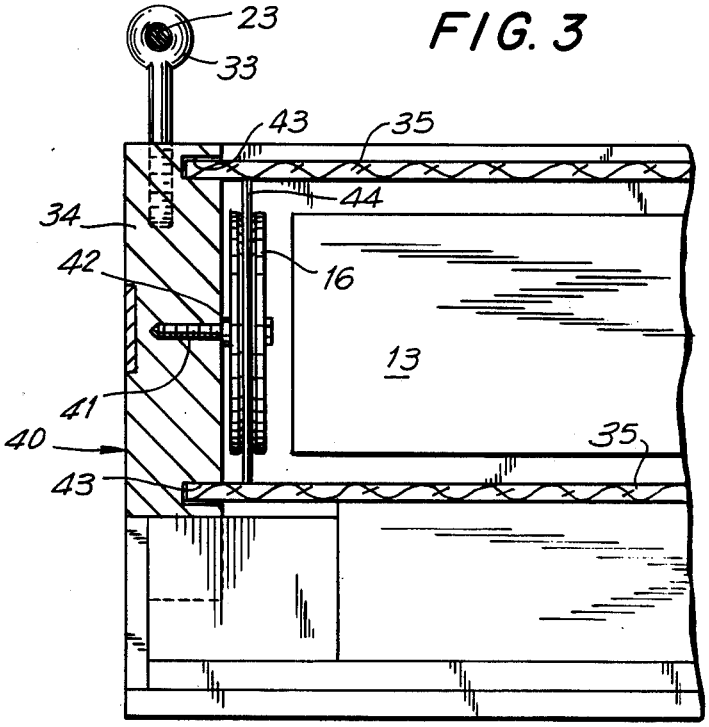
FIG. 3 is a fragmentary sectional plan view of portion of the embodiment of my invention illustrated in FIGS. 1 and 2.

Looking now at the portions of system 10 surrounding and connected to the article sought to be protected, namely painting 13, it is seen in FIG. 1 that a plurality of expandable open-eyed bolt members 33 provide a guiding support of painting 13 and its attachments to cables 23. Cables 23 extend downwardly through the eyes of bolt members 33 in a manner which will permit sliding movement of bolts 33 vertically over cables 23. FIG. 3 best illustrates the interconnection of bolts 33 to support plates 34 which will be described in more detail below. A flexible and fireproof/waterproof curtain member 35 is normally disposed behind the painting 13 and is secured to a weight member 36. Weight member 36 is normally held in the position shown in FIG. 1 by means of fuse 37 located beneath weight member 36. Alignment of all of these structural members being described for system 10 is facilitated by means of a built-in level 38, which permits the user to install and maintain system 10 in a configuration and orientation which will best serve the purposes for which the system is utilized. A receiving bracket 39 is located directly beneath and in the path of weight member 36 such that its descent will be limited by means of receiving bracket 39.

An overall frame, illustrated by reference character 40, includes support plates 34 and a number of other structural elements which normally support painting 13 in a manner already described and to be described below.

In order to facilitate a reliable movement of curtain member 35, pulley wheels 16 are provided and are mounted to support plates 34 by means of bolts 41. Optional bearings 42 of an inexpensive type may be provided to guarantee easy and reliable rotary movement of pulley wheels 16. Recesses 43 formed in support plates 34 provide guiding tracks which guide the travel and movement of curtain 35 along its path. An optional but preferred fireproof rope 44 is used to pull curtain 35 along its path. Thus, a tunnel effect is provided by means of which curtain 35 is able to clearly pass through the tunnel formed by the structure just described.

Container 26 and all other elements of the structure comprising system 10 are made of fireproof and waterproof materials, such as aluminum or other metals. In the case of container 26, seepage holes may be provided to release any liquids or water which find their way into the container. In operation, should a fire break out in the vicinity of painting 13, fuses 20 and 37 are activated either directly by means of the heat or smoke of this fire, or by means of signals generated by a source remote from painting 13 and not shown in FIG. 1. For example, should a fire break out in a room distant from painting 13 but in the same premises, with the present invention and system 10, signals from a transmitter remote from painting 13 will activate system 10 and fuses 20 and 37 such that the work of art is not exposed to the fire or water or smoke during the time that the fire progresses toward this work of art. In other words, this system is especially suited for museum and gallery environments in which the ultimate protection is desired.

Figure 2:
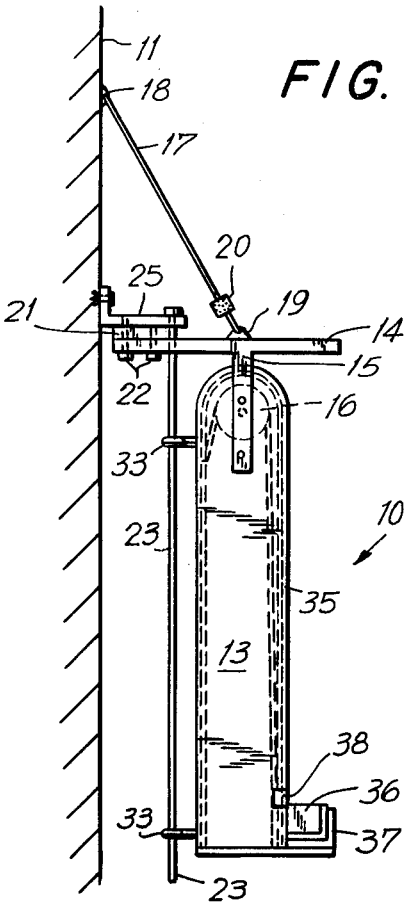
FIG. 2 is a fragmentary sectional elevational view of a portion of the system illustrated in FIG. 1.

Upon the activation of fuse 37, weight 36 is permitted to drop to and into mating engagement with receiving bracket 39, such as is illustrated in FIG. 2. The dropping of weight 36 causes curtain 35 to be pulled over the front of painting 13, thereby protecting same from heat and smoke and water. Water protection is necessary in establishments which may utilize a sprinkler system, apart from any water damage done by firefighting personnel and equipment.

In addition to the protection afforded by curtain 35, the activation of fuse 20 will cause a release of cable 17 such that the entire painting and attached structures will descend by gravity through the pivoting cover 31 and into the confines of container 26, best seen in FIG. 4.

Once fuse 20 is activated and cable 17 is released, painting 13 and its attached structures descends by means of bolt members 33 downwardly over cables 23 until this structure comes into contact with cover 31. Cover 31, under the influence of the weight of painting 13 and the rest of the structure, pivots out of the way into the position shown in FIG. 4, thereby permitting painting 13 to descend into the confines of container 26. Abrupt or sudden impact is prevented by means of springs 30, which act as shock absorbers. Furthermore, plate 14 acts as a lid, replacing cover 31, such that painting 13 or whatever article is being protected is insulated from heat, smoke and water. It is also contemplated that container 26 will serve as a security container, whereby unauthorized personnel will be incapable of gaining access to the work of art contained therewithin.

It is important for the reader to note that my invention, as exemplified by system 10 described hereinabove, may take the form of any number of different embodiments. More specifically, reference to FIG. 5 discloses a system 50 which represents an alternative yet desirable embodiment of the present invention. A work of art or painting 51 is shown in FIGS. 5 and 6. A frame assembly 52 supports painting 51 in spaced relationship with respect to a wall 11. A pair of brackets 53 on opposite sides of a curtain roll 54 supports a rod 55 upon which curtain roll 54 is supported. Curtain 54 basically consists of a fireproof, waterproof and heat resistant curtain 56 which is wound upon rod 55 and which is affixed at its front end to a weight member 57. Weight member 57 is retained in the position shown in FIG. 5 by means of a fuse 58. A receiving bracket 59 in the form of an angled metallic member is disposed beneath and in receiving relationship with respect to weight 57.

In addition to curtain 56, a second curtain 60 is disposed beneath curtain roll 54 and inside frame assembly 52. Curtain 60 is preferably supported on a second curtain roll 61 such that painting 51 is visible from the front of frame 52. It is also contemplated by the present invention to provide the second curtain 60 in a non-rolled configuration when not in use such that this second curtain may simply be pulled into protective position without being unwound from a curtain roll. Curtain 60 is secured to a weight member 62 which is retained in the position shown in FIG. 5 by means of a fuse 63. A receiving bracket 64 of the type already described for receiving bracket 59 is disposed beneath and in receiving relationship with respect to weight member 62.

The entire frame 52 and the painting 51 supported thereby is preferable either mounted directly to wall 11 by means of fasteners 65, or may be supported for descending movement much in the same manner as has already been described for the embodiment of my invention illustrated in FIGS. 1-4.

For the convenience of the reader, FIGS. 5 and 6 and the structures shown therein will be described now for a second curtain 60 which is not upon a curtain roll 61 but which is normally disposed in draped relationship with respect to painting 51 as shown in FIG. 5. In other words, for purposes of this specification, it will be assumed that painting 51 is visible from the left side, as shown in FIG. 5 through a window, for example. In this case, there will be no obstruction in the front of this painting 51 since curtain 60 is draped and is in hanging relationship behind the front of the painting, while curtain 56 upon curtain roll 54 is atop painting 51 and in non-interfering relationship therewith. Upon an emergency, such as a fire, fuses 58 and 63 will be activated, whereupon weights 57 and 62 will draw curtains 56 and 60 downwardly over both sides of painting 51, thereby protecting the entire painting from heat, water and smoke. A pulley wheel 66 and its associated fireproof rope 67 are shown in 56 and correspond to wheels 16 and rope 44 already described for FIG. 3 in the other embodiment of this invention.

A number of different manufacturers provide and supply fuses which may be used with the present invention. Norris Industries provide fusible links which will be activated at temperatures which are predetermined and preselected by the user.

A number of comments should be made here concerning the present invention which will aid the reader. The materials used in this structure are preferable fireproof, flameproof, smokeproof and waterproof. The curtains may be of a glass content. The Kidde Company provides a number of smoke control products.

It is contemplated by the present invention that the protective devices provided hereby be either automatically or manually triggered. The level 38 provided in both systems 10 and 60 assures proper clearances for the curtains, thereby eliminating situations where the travel of these fireproof curtains must overcome undesirable friction.

It is further contemplated that this system and my invention be cooperatively hooked up to an alarm system such that thefts as well damage can be prevented. The uses of my invention are far and wide and include libraries, fur houses, museums, galleries, fine jewelry houses, munition plants and depots, banks, computer rooms, and a host of other applications. It is important here to reemphasize that this invention is not and should not be limited to the protection of paintings, but is applicable to any number of articles which are sought to be protected. For example, in computer rooms, machines and records can be protected where the curtains can be coiled in a cylinder and mounted on the ceiling of the room within which the machines and records are kept. In the case of banks, a bulletproof curtain may be provided such that this bulletproof curtain can drop between a holdup man and a teller, thereby preventing any harm to the teller and foiling a holdup attempt.

The provision of double curtains, such as shown in FIG. 5, yield double protection. It is also contemplated that this system be modular to accommodate different size facilities and installations. It is also contemplated that this system be hooked up to a sprinkler auxiliary system to provide yet an additional mode of protection.

A number of observations and points that should be emphasized are as follows: The use of the words "protection" and "curtain" throughout the foregoing specification should be construed as including materials having insulating properties. Furthermore, in the operation of the curtains, there is no reliance upon electrical systems, springs, or manual power, as is the case in conventional or known systems.

It is also contemplated that container 26 be portable such that it can be used for the storage of works of art, such as paintings, and may be transported from one location to another. It is contemplated that once the work of art or painting is contained within container 26, a lock provided with the container is operated automatically, such as upon activation via the descent of the counterweight.

The curtains referred to this specification may be made of one, two, three or any multiple of layers, thereby providing superior insulation and affording a bulletproof shield if this invention is utilized in bank environments or other security areas. The provision of multiple curtain layers serves to reduce the ability of heat to travel through the curtain, thereby affording the user superior insulating properties. It is also contemplated for all exposed areas of the frame to be covered with fireproof material, including the back of the painting. Studs may be utilized with lockwashers for holding the curtain material against these exposed areas. Of course, sources of curtain and other component materials, other than the Kidde Company, may be utilized without departing from the scope of this invention.

The reader of this specification should not limit his concept of the present invention to protecting works of art. A number of other uses of this novel system may include isolating areas wherein heat and fire exist from other areas, such as aboard ships, vessels and vehicles. Computer rooms and libraries wherein memory and other important files are contained may also use this system. If permissible, the system may include an installation along the ceiling such that the curtain material descends to a verticle position. It is contemplated that activation in computer rooms may also activate the release of carbon dioxide or other smothering medium under the false floors usually utilized within these rooms, such that the supply of oxygen is cut off from the fire itself. With the cutting off of the supply of oxygen, the fire cannot be fed.

Yet another area in which the present invention may be utilized includes the control of all openings of air conditioning shafts and ducts. An automatic curtain operation responsive to a low-temperature fuse will act to stifle the fanning of a fire by cutting off the threatened area. Such an arrangment would also reduce the circulation of smoke from one area to another, it being remembered that smoke inhalation is quite often one of the most serious causes of personal injury resulting from fire. Utilizing the present invention, the circulation of smoke from one floor to another will result in the savings of lives and property.

The embodiments of the invention particularly disclosed and described herein are presented merely as examples of my invention. Other embodiments, forms and modifications of this invention coming within the proper scope and spirit of the appended claims will, of course, readily suggest themselves to those skilled in the art.

What is claimed is:

1. An aesthetically pleasing system for use in protecting articles of value, such as originally-framed paintings or the like, from an undesirable environment, comprising, in combination: a protective enclosure capable of isolating its contents from water, fire and heat, said enclosure having five substantially sealed walls joined with one another and an upper cover hinged along one edge, said cover being movable between sealing and open positions, said enclosure further including cushioning spring means disposed at an inner base thereof, said enclosure also including an anchor bracket located within said five walls, an article support assembly secured by means of a fuse retainer at an exhibiting elevation above said protective enclosure, said article support assembly including a substantially flat plate member integral with a pair of depending strut members which carry the weight of an article of value supported therebetween, said plate member being of a predetermined size and shape conforming to the size and shape of an enclosure opening normally sealed by said cover, said fuse retainer releasably holding said article support assembly at said exhibiting elevation and being responsive to an emergency signal which will cause the release of said plate and strut members thereby enabling their descent under the influence of gravity, and guide means interconnected between said support assembly and said protective enclosure for guiding the path of said article of value upon said release by the fuse retainer in response to said emergency signal, said path terminating with said article and article support assembly coming to cushioned rest against said cushioned spring means within said protective enclosure that is sealed shut by sealing contact between said flat plate member and enclosure surfaces defining said enclosure opening, said article support assembly further including movable curtain means resistant to said undesirable environment for protecting an article of value, means for guiding the path of said movable curtain means, weight means for influencing the movement of said curtain means, stop means for limiting the movement of said curtain means, and retaining means responsive to heat for initially retaining said curtain means in an initial position, said movable curtain means including a pulley assembly supported by said article support assembly, at least one curtain supported by said pulley assembly in an initial position and movable with portions within track recesses to an emergency position, said weight means comprising a relatively heavy member integral with a forward portion of said curtain, said retaining means comprising a fuse which is responsive to heat disposed with portions thereof in the gravitational path of said heavy member, said stop means comprising a bracket member of a shape adapted to receive and obstruct the path of said heavy member, whereupon at a predetermined environmental temperature said fuse and said fuse retainer will respond, thereby causing both the curtain to fall under the influence of said heavy member into an emergency position covering the article of value and the entire article support assembly and covered article to descend into the protective enclosure.

* * * * *